United States Patent [19]

Zoellick

[11] 4,081,103

[45] Mar. 28, 1978

[54] COVER FOR DRINKING CONTAINERS

[76] Inventor: Allen Peter Zoellick, 2300 N. Mayfair Rd., Milwaukee, Wis. 53226

[21] Appl. No.: 670,663

[22] Filed: Mar. 26, 1976

[51] Int. Cl.[2] ..... A47G 19/22; B65D 41/48

[52] U.S. Cl. ..... 220/254; 220/90.4; 220/268; 222/541; 229/7 R

[58] Field of Search ..... 220/266, 254, 268, 90.2, 220/90.4, 90.6; 229/7 R, 43; 222/541; 215/253

[56] References Cited

U.S. PATENT DOCUMENTS

| | | | |
|---|---|---|---|
| 3,076,584 | 2/1963 | Sherlock | 220/226 |
| 3,227,304 | 1/1966 | Asbury | 220/268 |
| 3,355,058 | 11/1967 | Asbury | 222/341 |
| 3,362,569 | 1/1968 | Geiger | 220/268 |
| 3,739,976 | 6/1973 | MacDaniel | 229/43 |
| 3,927,794 | 12/1975 | Erdman | 229/7 R |

*Primary Examiner*—William Price
*Assistant Examiner*—Allan N. Shoap
*Attorney, Agent, or Firm*—Michael, Best & Friedrich

[57] ABSTRACT

Disclosed herein is a cover for drinking containers, such as coffee cups and the like, including a peripheral rim section adapted to fit snugly over the rim of the container, a resilient cover panel extending between the confines of the rim section to cover the container, a generally U-shaped cut or score line in the cover panel defining a correspondingly shaped flap having an outer edge portion located near the rim section, an an inner portion which is integrally connected to the main body of the cover panel main body, and raised reinforcing contours on the flap and on the cover panel main body including parallel spaced portions located adjacent the junction between the flap inner portion and the cover panel main body defining a transverse hinge axis for the flap, whereby the flap can be depressed relative to the cover panel to provide an opening in the cover panel for drinking from one side of the container and whereby the flap, upon being released, returns to a normal position where it substantially closes the opening.

The cover can be conveniently formed as a one-piece unit from a thin sheet of polymeric thermoplastic material, such as by vacuum forming, and the cut or score line thereafter made in the cover panel.

8 Claims, 3 Drawing Figures

COVER FOR DRINKING CONTAINERS

BACKGROUND OF THE INVENTION

This invention relates to covers for drinking containers, such as coffee cups, and, more particularly, to such covers which prevent spillage and yet permit drinking from the container without removal of the cover.

Non-spill covers for drinking container are desirable for many applications. A typical application for covers of this type is on coffee cups to be used in a moving vehicle. Non-spill drinking container covers proposed in the past typically either require relatively complex parts, such as separate valve structures, or are arranged so that ingredients, such as cream and sugar, cannot be conveniently added to the container and stirred without removing the cover. Representative examples of prior art constructions for non-spill covers for drinking containers are disclosed in the following United States Patents:

Freemyer: U.S. Pat. No. 3,868,043 issued Feb. 25, 1975

Serritella: U.S. Pat. No. 3,800,999 issued Apr. 2, 1974

Dibrell: U.S. Pat. No. 3,797,696 issued Mar. 19, 1974

Dibrell et al.: U.S. Pat. No. 3,730,399 issued May 1, 1973

Gardner: U.S. Pat. No. 3,301,459 issued Jan. 31, 1967

Spalding et al.: U.S. Pat. No. 3,646,670 issued July 28, 1953

SUMMARY OF THE INVENTION

The invention provides a cover for drinking containers including a rim section adapted to fit snugly over the rim of the container, a resilient cover panel extending between the confines of the rim section to cover the container, a generally U-shaped cut or score line in said cover panel defining a correspondingly shaped flap having an outer edge portion located near said rim section and an inner portion which is integrally connected to the cover panel main body, and raised reinforcing contours on the flap and on the cover panel main body including parallel spaced portions located adjacent the junction between the flap inner portion and the cover panel main body defining a transverse hinge axis for the flap. The flap can be depressed relative to the cover panel to provide an opening in the cover panel for drinking from one side of the container and, upon being released, returns to a normal position where it substantially closes this opening.

In accordance with one embodiment, raised, rounded lips are provided along the respective marginal edges of the flaps and the cover panel adjacent the cut or score line so as to minimize injury to the user's lips during drinking.

In accordance with another embodiment, a raised button is provided on the flap, which button is located to facilitate depressing the flap by the user with the thumb on the same hand holding the cup. The top surface of this button preferably is raised a sufficient distance from the underside of the flap so that, when the container contains a hot liquid, such as coffee, this top surface remains cool enough for the user to touch with his thumb for depressing the flap without discomfort.

One of the principal features of the invention is to provide a simple and inexpensive cover for drinking containers.

Another of the principle features of the invention is to provide a single piece drinking container cover which can be used with containers containing a hot liquid, such as coffee, and can be conveniently and safely opened for drinking the hot liquid from one side of the container.

Still another of the principal features of the invention is to provide a cover of the last mentioned type which permits the addition of ingredients, such as cream and sugar, and stirring without removal of the cover from the container.

Other features, advantages and aspects of the invention will become apparent upon reviewing the following detailed description, the drawing and the appended claims.

Figure 1:
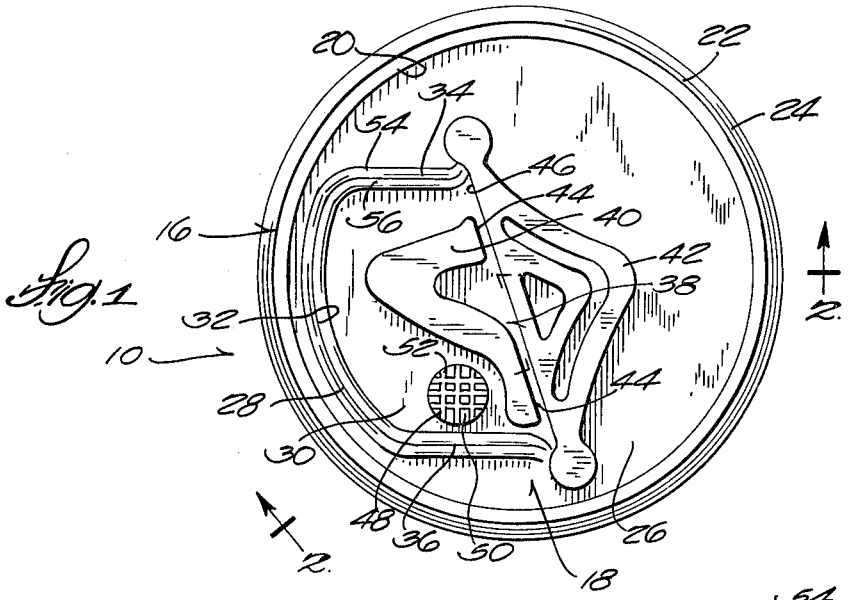
FIG. 1 is a top plan view of a cover embodying various of the features of the invention shown installed on a disposable coffee cup.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

GENERAL DESCRIPTION

Illustrated in a drawing is a cover 10 embodying the invention and shown installed on a conventional, circular drinking container 12, such as a disposable coffee cup made from a foamed plastic material and including a normally open lip or rim 14. While the primary intended use of the cover 10 is for installation on a drinking container after the container has been filled with a liquid, it can also be installed on a drinking container before filling if desired.

The cover 10 is formed from a relatively rigid, resilient material and includes an annular, peripheral rim section 16 which is dimensioned to fit snugly over the periphery of the cup rim 14 with a press-on fit to securely hold the cover 10 on the cup 12 and a cover panel 18 which extends between the confines of the rim section 18 and covers the cup 12 when the cover 10 is installed.

The rim section 16, in cross section, has an upwardly extending bight defined between an inner, circular circumferential flange 20 and an outer, circular circumferential flange 22. To facilitate installation and removal of the cover 10, the outer flange 22 preferably terminates in an out-turned peripheral lip 24 which assists guiding of the rim section 16 over the cup rim 14 during installation of the cover 10 and can be conveniently gripped with the user's fingertips to lift the cover 10 off the cup 12.

The cover panel 18 has a main body 26 and a generally U-shaped cut or score line 28 which defines a correspondingly, generally U-shaped flap 30 having an outer edge portion 32 located near the inner flange 20, opposed, inwardly extending side portions 34 and 36, and an inner portion 38 which is integrally connected to the main body 26 of the cover panel 18. Provided on the flap 30 and the main body 26 of the cover panel 28 are respective raised reinforcing contours 40 and 42 including parallel spaced portions 44 and 46 which are located adjacent the junction of the flap inner portion 38 and the cover panel main body 26 and which define a transverse hinge axis for the flap 30.

Figure 2:
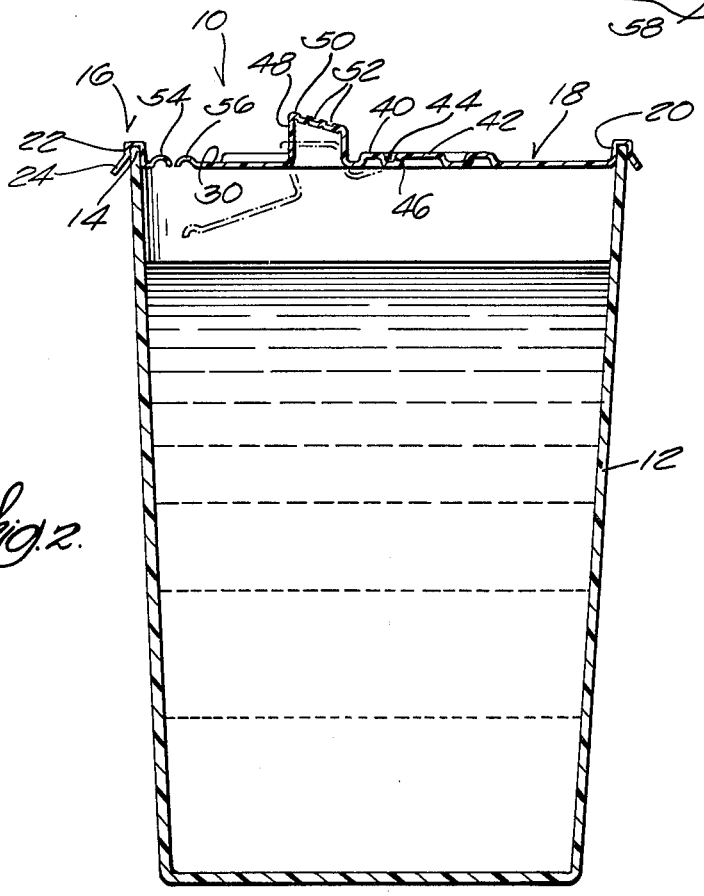
FIG. 2 is a sectioned, elevational view taken along the line 2—2 in FIG. 1.

With this arrangement, the flap 30 can be depressed relative to the main body 26 of the cover panel 18 to provide an opening as shown in FIG. 2 for drinking from one side of the cup 12. Since the cover 10 is made from a relatively rigid, resilient material, the flap 30, upon being released, snaps back or returns to a normal position, generally coplanar with the main body 26 of the cover panel 18, where it closes the opening except for the small spacing of score line 28. Further, when the flap 30 is depressed, the resultant opening permits the convenient addition of ingredients such as sugar and cream, as well as the insertion of a spoon or the like for stirring, without removing the cover 10. Also, if desired, the cover 10 can be installed on the cup 12 before filling, and the cup subsequently filled through the opening provided when the flap 30 is depressed.

The flap 30 preferably is provided with a raised button 48 which is disposed at a location where the user can conveniently reach it and depress the flap 34 with the thumb on the same hand holding the cup 12. As is the case for conventional drinking container covers, the cover panel 18 and the flap 30 usually is considerably thinner than the walls of the cup 12. Consequently, when the cup 12 is filled with a hot liquid such as coffee, the flap 30 can become quite hot. The top surface 50 of the button 48 preferably is located far enough away from the underside of the flap 30 so that any hot liquid contacting the underside of the flap, prior to and during drinking, does not cause this surface to become hot to the touch, permitting the user to depress the flap 30 with his thumb without discomfort.

In order to minimize the possibility of the user's thumb slipping off the button 48 while depressing the flap 30, a plurality of small indentations or notches 52 can be provided in the top surface 50, preferably in a cross-hatched pattern shown in FIG. 1. Also, the top surface 50 of the button 48 preferably is sloped upwardly in a direction towards the outer edge portion 32 of the flap 30 so that it is substantially horizontal or generally coplanar with the cover panel 18 when the flap 30 is fully depressed as shown in FIG. 2.

To minimize the possibility of injury to the user's lips during drinking, raised round lips 54 and 56 preferably are provided along the respective marginal edges of the flap 30 and the main body 26 of the cover panel 18 adjacent the score line 28.

Figure 3:
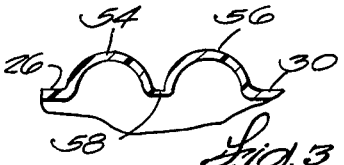
FIG. 3 is an enlarged fragmentary view of an alternate arrangement for forming the score line defining the depressible flap.

While various fabrication techniques and materials can be used, the cover 10 preferably is formed as a one-piece unit from a thin sheet of a polymeric thermoplastic material, such as a high density polyethylene, using standard vacuum-forming techniques. The polymeric material used is of a type which will provide a relatively rigid structure and yet has sufficient resiliency to provide the above-described spring back action of the flap 30. The lips 54 and 56 are spaced closely together and the score line 28 can be made therebetween after molding with a suitable thin cutting device. Alternately, as shown in FIG. 3, a frangible, narrow web section 58 can be formed between the lips 54 and 56 during molding, which web section 58 is sufficiently thin so as to be easily ruptured to form the score line 28 by simply depressing the flap 30 before or after the cover 10 is installed on the cup 12.

While a cover embodying the invention has been described for use with a circular disposable cup, it should be understood that it can be adapted for use on ordinary plastic or glass drinking containers used for a variety of purposes and having a variety of configurations.

Various of the features of the invention are set forth in the following claims.

What is claimed is:

1. A cover for a drinking container having a rim, said cover made from a resilient non-metallic material and comprising a peripheral rim section adapted to fit snugly over the rim of the container, and a resilient cover panel extending between the confines of said rim section to cover the container and having a main body, said cover panel also having a generally U-shaped weakening line defining a corresponding shaped flap having flat side margins extending along and in adjacently spaced relation from said U-shaped weakening line, said flap having an outer edge portion located near said rim section and bounded by said side margins, and said flap having an inner portion hingedly and integrally connected to said main body, a raised transverse reinforcing contour on said main body extending across the ends of said U-shaped weakening line and including a portion located adjacent the junction between said flap inner portion and said main body, and a raised reinforcing contour on said flap and having a portion located adjacent the junction between said flap inner portion and said main body in parallel relation to said portion of said reinforcing contour on said main body so as to define a resilient, stable transverse hinge axis for said flap extending between said parallel portions of said reinforcing contours, said flap being depressible relative to said main body to provide an opening for drinking from one side of the container by causing rupture of said U-shaped weakening line adjacent said outer edge portion and said side margins, said flap returning to a normal redepressible position where it substantially closes the opening upon being released from a depressed position in response to the resiliency of said hinge axis.

2. A cover according to claim 1 wherein said main body includes a raised, rounded lip located adjacent said U-shaped weakening line and wherein said flap includes a raised rounded lip located adjacent said U-shaped weakening line.

3. A cover according to claim 2 wherein said U-shaped weakening line is formed with a thin frangible section between said lips which section can be ruptured by depressing said flap.

4. A cover according to claim 1 wherein said flap includes a raised button which is located to facilitate depressing said flap by the user with the thumb on the same hand holding the container.

5. A cover according to claim 4 wherein said button has a top surface including a plurality of indentations for minimizing slippage of the user's thumb off said button while depressing said flap.

6. A cover according to claim 4 wherein said button has a top surface which slopes upwardly in a direction toward said flap outer end portion so that it is substantially coplanar with said cover panel when said flap is depressed for drinking.

7. A cover according to claim 1 wherein said cover is vacuum formed as a one-piece unit from a sheet of polymeric thermoplastic material.

8. A single piece cover for a drinking container having a rim, said cover being made from a relatively rigid, resilient polymeric thermoplastic material and comprising a peripheral rim section adapted to fit snugly over the rim of the container and a cover panel extending between the confines of said rim section to cover the container and having a main body, said cover panel also having a generally U-shaped weakening line defining a correspondingly shaped flap having flat side margins extending along and in adjacently spaced relation from said score line, said flap having an outer edge portion located near said rim section and bounded by said side margins, and said flap having an inner portion hingedly and integrally connected to said main body, a raised transverse reinforcing contour on said main body extending across the ends of said U-shaped weakening line and including a portion located adjacent the junction between said flaps and said main body, and a raised reinforcing contour on said flap and having a portion located adjacent the junction between said flap inner portion and said main body in parallel relation to said portion of said raised reinforcing contour on said main body so as to define a resilient, stable transverse hinge axis for said flap being depressible relative to said main body to provide an opening in said cover panel for drinking from one side of the container by causing rupture of said weakening line adjacent said outer edge portion and said side margins, said flap returning to a normal redepressible position where it substantially closes said opening upon being released from a depressed postion in response to the resiliency of said hinge axis, said main body including a raised, rounded lip located adjacent said U-shaped weakening line, said flap including a raised button to facilitate depressing said flap by the user with the thumb on the same hand holding the cup, and said flap having a raised, rounded lip located adjacent said U-shaped weakening line.

* * * * *